United States Patent [19]

Wakalopulos

[11] 3,970,892

[45] July 20, 1976

[54] ION PLASMA ELECTRON GUN

[75] Inventor: George Wakalopulos, Los Angeles, Calif.

[73] Assignee: Hughes Aircraft Company, Culver City, Calif.

[22] Filed: May 19, 1975

[21] Appl. No.: 578,551

[52] U.S. Cl. ..... 315/111.3; 313/231.3; 313/363; 315/111.8

[51] Int. Cl.[2] ..... H01J 7/24

[58] Field of Search..... 315/111.2, 111.3, 111.8; 313/231.3, 231, 363

[56] References Cited

UNITED STATES PATENTS 3,831,052 8/1974 Knechtli..... 313/231 X

*Primary Examiner*—R. V. Rolinec
*Assistant Examiner*—Darwin R. Hostetter
*Attorney, Agent, or Firm*—Paul M. Coble; W. H. MacAllister

[57] ABSTRACT

In the disclosed electron gun positive ions generated by a hollow cathode plasma discharge in a first chamber are accelerated through control and shield grids into a second chamber containing a high voltage cold cathode. These positive ions bombard a surface of the cathode causing the cathode to emit secondary electrons which form an electron beam having a distribution adjacent to the cathode emissive surface substantially the same as the distribution of the ion beam impinging upon the cathode. After passing through the grids and the plasma discharge chamber, the electron beam exits from the electron gun via a foil window. Control of the generated electron beam is achieved by applying a relatively low control voltage between the control grid and the electron gun housing (which resides at ground potential) to control the density of the positive ions bombarding the cathode.

10 Claims, 2 Drawing Figures

ION PLASMA ELECTRON GUN

Figure 1:
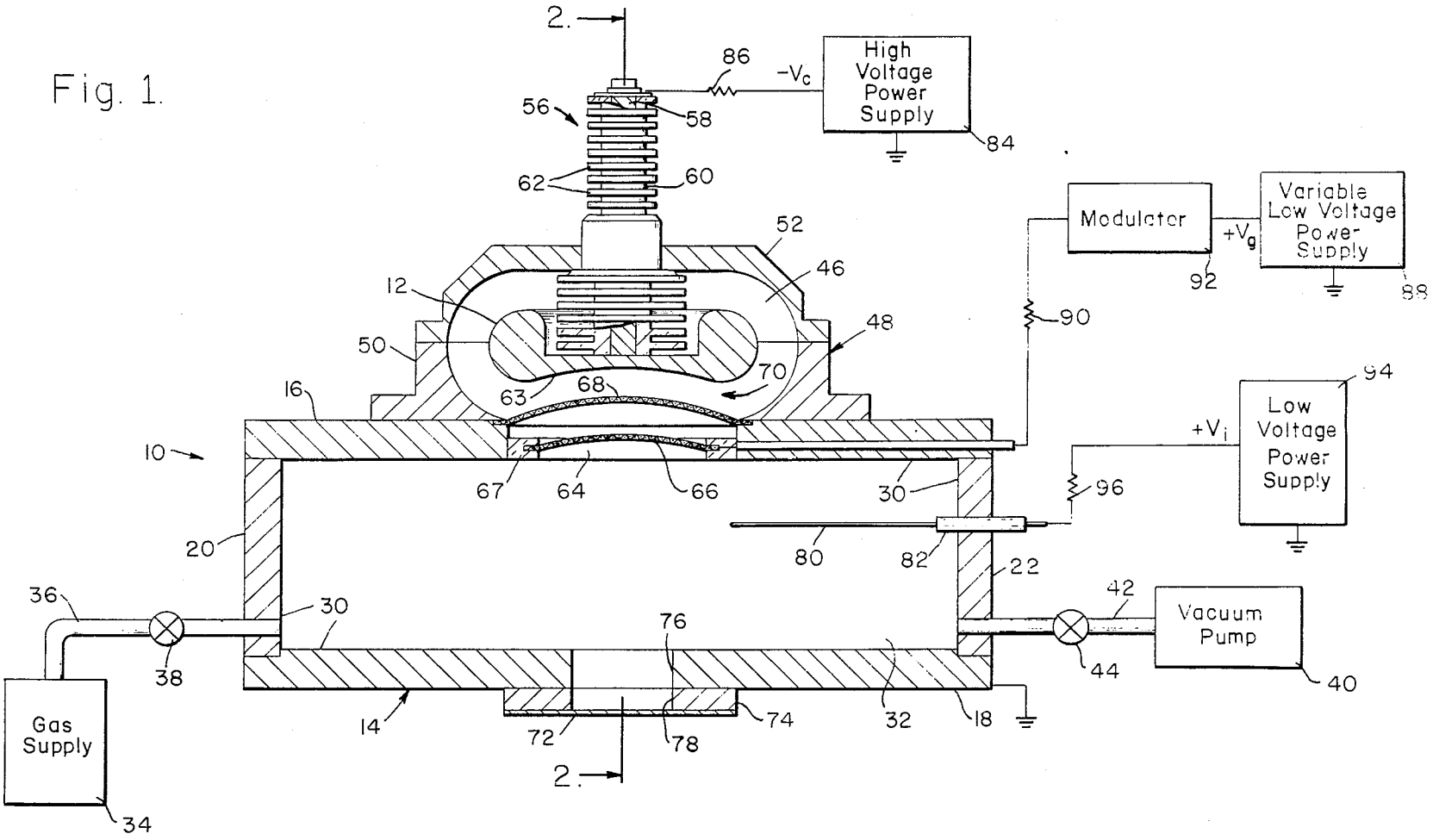

This invention relates to the generation of electron beams, and more particularly relates to an electron gun wherein the electron beam is generated by bombarding a high voltage cold cathode with high energy positive ions.

A recent advance in the art of generating high energy electron beams, for use in *e*-beam excited gas lasers for example, is the plasma cathode electron gun. In such electron gun a plasma is produced in a hollow cathode discharge between the hollow cathode surface and an anode grid operated at a relatively low voltage (typically several hundred volts) with respect to the cathode. Electrons are extracted from the discharge plasma through the anode grid and a control grid, and these electrons are accelerated to high energies in a plasma-free region between the grids and an accelerating anode (typically a thin foil window) maintained at a relatively high voltage (e.g., 150 kv or more) with respect to the cathode. Among the advantages of the plasma cathode electron gun are its structural simplicity and ruggedness, high controllability and efficiency, low cost, and suitability for producing large area electron beams. For further details concerning the plasma cathode electron gun, reference may be made to J. R. Bayless and R. C. Knechtli, "The Plasma-Cathode Electron Gun," IEEE *Journal of Quantum Electronics*, Vol. QE-10 (February 1974), pages 213–218, and to U.S. Pat. No. 3,831,052, issued Aug. 20, 1974 to R. C. Knechtli, entitled "Hollow Cathode Gas Discharge Device" and assigned to the assignee of the present invention.

In most applications employing a plasma cathode electron gun, it is undesirable to apply high voltages to the working medium through which the generated electron beam passes. Therefore, it is customary to operate the electron gun accelerating anode (foil window in the case of an *e*-beam excited gas laser) at ground potential and to apply a large negative voltage to the electron gun cathode. However, this requires that the anode and control grids, which are used to modulate and tailor the electron beam, be biased relative to large negative potentials.

It is an object of the present invention to provide an electron gun for generating a high energy electron beam which retains all of the advantages of the plasma cathode electron gun and at the same time is operable with relatively low control voltages.

It is a further object of the invention to provide an electron gun capable of generating a readily controllable, high energy electron beam and having improved structural simplicity and ruggedness and occupying less volume and weight than otherwise comparable electron guns of the prior art.

An electron gun according to the invention comprises a source of positive ions including a plasma region and a cathode spaced from the ion source and positioned to intercept positive ions extracted from the source. A large negative voltage is applied to the cathode causing positive ions generated by the ion source to bombard a surface of the cathode such that secondary electrons are emitted from the cathode surface to form an electron beam. At least one grid electrode is disposed between the plasma region and the cathode to control the density of the positive ions bombarding the cathode surface and thereby control the generated electron beam.

Figure 2:
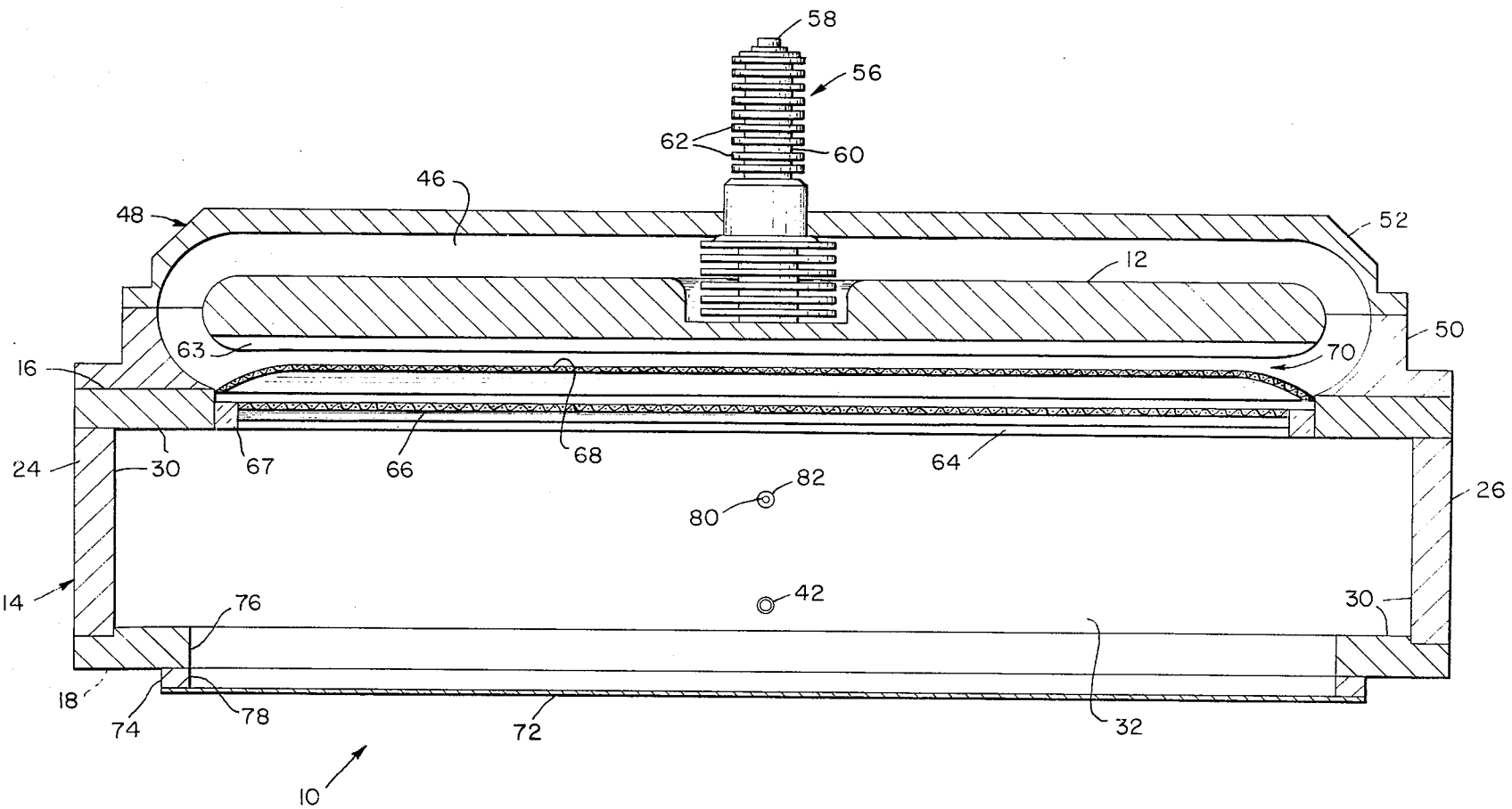

Additional objects, advantages and characteristic features of the present invention will become apparent from the following detailed description of a preferred embodiment of the invention when considered in conjunction with the accompanying drawing wherein:

FIG. 1 is a cross-sectional view illustrating an electron gun according to the invention; and FIG. 2 is a longitudinal sectional view taken along line 2—2 of FIG. 1.

Referring to the drawing with greater particularity, an electron gun according to the invention may be seen to include a hollow cathode ion source 10 which generates positive ions used to bombard the surface of a high voltage cold cathode 12. The ion source 10 is constructed with a metal housing 14, illustrated as having a rectangular cross-section and formed from opposing broad wall members 16 and 18 and side wall members 20, 22, 24 and 26. The junctions between adjacent housing wall members and between wall members and components extending through the wall members may be provided with O-ring gaskets (not shown) to ensure vacuum integrity of the interior of the housing 14. The inner surfaces of the wall members 16, 18, 20, 22, 24 and 26 form an electron emissive hollow cathode surface 30 and may be provided with a coating of desired electron emissive material. As a specific illustrative example, the wall members 16, 18, 20, 22, 24 and 26 may be of aluminum, with their inner surfaces provided with a 2–3 mil coating of nickel.

The interior of ion source housing 14, which functions as a plasma discharge region 32, contains a desired ionizable gas at a desired evacuated pressure. Accordingly, a gas supply 34 is coupled to the interior of housing 14 by means of an intake tube 36 provided with a control valve 38, while a vacuum pump 40 is similarly coupled to the interior of housing 14 via exhaust tube 42 provided with leak valve 44. As a specific example for illustrative purposes, the ionizable gas within the housing 14 may be helium at a pressure ranging from about 10 to about 50 Torr.

The high voltage cold cathode 12 is mounted within a chamber 46 in gas flow communication with the interior of ion source housing 14 and defined by a metal housing 48 disposed adjacent to the ion source housing 14. In order to afford ready access to high voltage cathode 12, housing 48 is preferably constructed in two sections, i.e., with a base member 50 attached to ion source wall member 16 (for example by bolts, not shown) and a cap member 52 similarly attached to base member 50. As a specific illustrative example, housing members 50 and 52 may be of aluminum, with a 2–3 mil nickel coating provided on their interior surfaces. Again, O-ring gaskets (non shown) may be provided to ensure the vacuum integrity of the chamber 46.

The high voltage cold cathode 12 consists of an elongated body of electrically conductive material such as nickel or molybdenum centrally supported within chamber 46 by means of a high voltage feedthrough arrangement 56 attached to housing cap 52. Feedthrough arrangement 56, which enables a large negative voltage to be applied to cathode 12, prefeably includes an electrically conductive rod 58 attached to cathode 12 and disposed within an insulating sleeve 60. Sleeve 60, which may be of nylon, for example, defines a plurality of annular ridges 62 along its outer surface. For those applications where a converging electron beam is desired, the surface 63 of cathode 12 which faces ion source 10 may be made slightly concave (as shown in FIG. 1) with respect to an axis perpendicular to the plane of FIG. 1.

In order to enable positive ions from the ion source 10 to enter the high voltage cathode chamber 46 and to allow electrons emitted by cathode 12 to travel into the ion source 10, ion source wall member 16 defines an elongated aperture 64 substantially aligned with the cathode 12. A control grid 66, contoured to substantially conform to cathode surface portion 63, is mounted across aperture 64 in insulating frame 67. Grid 66 not only controls the density of positive ions passing through aperture 64 and thereby achieves modulation and tailoring of the generated electron beam, but it also functions as an anode for the hollow cathode discharge in ion source 10. A shield grid 68, also contoured to conform to cathode surface portion 63, is mounted across aperture 64 between control grid 66 and high voltage cathode 12. Shield 68, which resides at the same electrical potential as the housings 14 and 48, prevents electric fields in the high voltage cathode chamber 46 from leaking into the hollow cathode plasma region 32 and thereby serves to electrically separate the high voltage cathode chamber 46 from the ion source 10. Each of the grids 66 and 68 may be molybdenum wire meshes having a transparency of about 75% for example.

The space between shield grid 68 and cathode surface portion 63 functions as an acceleration region 70 in which positive ions extracted from ion source 10 attain the high velocities at which they bombard the cathode 12. The spacing between shield grid 68 and cathode surface 63 must be less than the value for Paschen breakdown in order to preclude initiation of a discharge in the acceleration region 70. Typically, this spacing is around 2–3 cm.

Disposed on the side of ion source 10 opposite the high voltage cathode 12 is an electron beam window element 72. Window element 72 consists of a thin metallic foil, of titanium for example, mounted on an elongated support member 74 which is attached to ion source housing wall member 18, for example by bolts (not shown). The window element 72 enables the generated electron beam to exit from the electron gun with the desired velocity while at the same time allowing the appropriate pressure to be maintained with the housings 14 and 48. Elongated aligned apertures 76 and 78 are provided in ion source wall member 18 and window support member 74, respectively, in alignment with respective portions of aperture 64 and cathode surface 63 to provide a passage for the generated electron beam to window element 72.

In order to aid in initiating a hollow cathode discharge within ion source 10, a thin wire ignition electrode 80 is provided within ion source 10. The ignition electrode 80 projects into plasma region 32 of ion source 10 through a side wall such as 22 and is insulated therefrom by means of an electrically insulating sleeve 82. Ignition electrode 80 enables a hollow cathode discharge to commence within region 32 at a lower gas pressure than would be possible without electrode 80 and also facilitates maintaining a stable discharge within ion source 10.

Operating voltages for the electron gun may be provided by a high voltage power supply and one or more low voltage power supplies. Specifically, high voltage power supply 84 has its negative terminal connected via resistor 86 to high voltage cathode feed conductor 58 to furnish the desired high voltage cathode potential $-V_c$, which may be around −150 Kv, for example. A variable low voltage power supply 88 has its positive terminal coupled via resistor 90 to control grid 66 to furnish the desired grid voltage $+V_g$, which typically may range from about +500 to about +1000 volts. A modulator 92 may be coupled between power supply 88 and control grid 66 to vary the voltage applied to grid 66 in accordance with a control signal and thereby modulate and tailor the generated electron beam as desired. A further low voltage power supply 94 has its positive terminal coupled via resistor 96 to ignition electrode 80 to supply ignition electrode voltage $+V_i$, which may be about +3000 volts, for example. It is pointed out that while separate power supplies 88 and 94 are shown for the grid and ignition electrodes 66 and 80, respectively, a single low voltage power supply may be employed, along with appropriate voltage dividing circuitry to furnish operating potentials for the electrodes 66 and 80. The ion source and high voltage cathode housings 14 and 48, respectively, are maintained at ground potential in the hereindescribed preferred embodiment of the invention.

In the operation of the electron gun of the invention, upon the application of the aforementioned positive voltages to the ignition electrode 80 and the control grid 66, a hollow cathode discharge is commenced within region 32 of ion source 10, thereby producing a plasma within region 32 containing positive ions and electrons. When a large negative voltage is applied to high voltage cold cathode 12, positive ions in the plasma region 32 are attracted to the cathode 12. These positive ions are extracted from ion source 10 via grids 66 and 68 and are rapidly accelerated to very high velocities as they travel through acceleration region 70 under the influence of the large negative voltage applied to cold cathode 12. Bombardment of cold cathode 12 by these high energy positive ions causes cathode 12 to emit secondary electrons which form an electron beam having a distribution adjacent to the emissive surface of cathode 12 substantially the same as the distribution of the ion beam impinging upon the cathode 12. The generated electron beam passes through the grids 68 and 66 and the plasma region 32 and exits from the electron gun via window element 72. The beam electrons are accelerated to sufficiently high velocities by the grids 68 and 66 and their path through plasma region 32 is sufficiently short so that these electrons traverse region 32 with little effect.

In the electron gun of the invention, since the high energy electron beam is generated from an ion beam, and since the ion source housing 14 resides at ground potential, the electron beam can be modulated and tailored with respect to ground potential rather than high voltage levels. Thus, the electron gun of the invention is operable with relatively low control voltages, and only the high voltage cathode 12 and its feed circuitry need be constructed to withstand high voltages of the order of 150 Kv. This enables the electron gun of the invention to possess improved structural simplicity and ruggedness and occupy less volume and weight than otherwise comparable electron guns of the prior art.

It is further pointed out that bombardment of the cold cathode 12 with high energy positive ions causes heating of the cathode 12 and of the surrounding gas in the chamber 46. This provides several beneficial results. First, it reduces any tendency for sputtered cathode material to deposite onto insulating surfaces within the chamber 46. Also, it lowers the gas density within the chamber 46 and thus decreases the probability of Paschen breakdown. In addition, a hotter cathode surface has a greater tendency to maintain spatially uniform electron emission. Thus, in addition to the foregoing advantages, an electron gun according to the invention is reliable and efficient in operation, relatively inexpensive, and highly suitable for producing readily controllable, large area electron beams.

Although the present invention has been shown and described with reference to a particular embodiment, nevertheless various changes and modifications obvious to a person skilled in the art to which the invention pertains are deemed to lie within the spirit, scope and contemplation of the invention.

What is claimed is:

1. An electron gun comprising:

a source of positive ions including a plasma region;

a cathode spaced from said ion source and positioned to intercept positive ions extracted therefrom;

means for applying to said cathode a large negative voltage sufficient to cause positive ions generated by said ion source to bombard a surface of said cathode such that secondary electrons are emitted therefrom to form an electron beam; and said ion source including grid electrode means disposed between said plasma region and said cathode for controlling the density of the positive ions bombarding said cathode surface.

2. An electrode gun according to claim 1 wherein said source of positive ions includes a hermetically sealed electrically conductive housing containing an ionizable gas, and means for establishing a plasma discharge within said housing whereby positive ions are generated therein.

3. An electron gun according to claim 2 wherein said means for establishing said plasma discharge includes means for applying a relatively low voltage between said grid electrode means and said housing.

4. An electron gun according to claim 2 wherein the inner walls of said housing constitute a hollow cathode for said plasma discharge.

5. An electron gun according to claim 2 wherein said means for establishing said plasma discharge includes a thin wire electrode projecting into said housing, and means for applying a relatively low voltage between said thin wire electrode and said housing.

6. An electrode gun comprising:

hermetically sealed housing means defining first and second chambers disposed adjacent to one another and having an opening therebetween;

an ionizable gas contained within said first and second chambers;

a cathode disposed within said second chamber and having an electron emissive surface facing said opening;

means for establishing a plasma discharge within said first chamber whereby positive ions are generated therein;

means for applying to said cathode a large negative voltage sufficient to cause positive ions generated within said first chamber to travel through said opening into said second chamber and bombard said electron emissive surface such that secondary electrons are emitted therefrom to form an electron beam;

grid electrode means disposed across said opening for controlling the density of positive ions passing therethrough; and an electron transmissive window attached to said housing means and aligned with at least a portion of said electron emissive surface.

7. An electron gun comprising:

hermetically sealed housing means defining first and second chambers disposed adjacent to one another and having an opening therebetween;

an ionizable gas contained within said first and second chambers;

a cathode disposed within said second chamber and having an electron emissive surface facing said opening and oriented substantially parallel thereto;

means for establishing a plasma discharge within said first chamber whereby positive ions are generated therein;

means for applying to said cathode a large negative voltage sufficient to cause positive ions generated within said first chamber to travel through said opening into said second chamber and bombard said electron emissive surface such that secondary electrons are emitted therefrom to form an electron beam which travels through said opening into said first chamber;

grid electrode means disposed across said opening for controlling the density of positive ions passing therethrough; and an electron transmissive window attached to said housing means and aligned with at least respective portions of said opening and said electron emisive surface.

8. An electron gun comprising:

hermetically sealed electrically conductive housing means defining first and second chambers disposed adjacent to one another and having an opening therebetween;

an ionizable gas contained within said first and second chambers;

a cathode disposed within said second chamber and having an electron emissive surface facing said opening;

whereby for establishing a plasma discharge within said first chamber wherby positive ions are generated therein;

means for applying to said cathode a large negative voltage sufficient to cause positive ions generated within said first chamber to travel through said opening into said second chamber and bombard said electron emissive surface such that secondary electrons are emitted therefrom to form an electron beam;

a control grid electrode disposed across said opening, means for applying a control voltage to said control grid electrode to control the density of positive ions passing therethrough;

a shield grid electrode disposed across said opening between said control grid electrode and said cathode and directly electrically connected to said housing means; and an electron transmissive window attached to said housing means and aligned with at least a portion of said electron emissive surface.

9. An electron gun according to claim 8 wherein said electron emissive surface has a slightly concave configuration as viewed from said opening, and said control and shield grid electrodes are contoured to substantially conform to said slightly concave configuration.

10. An electron gun comprising:

hermetically sealed electrically conductive housing means defining first and second chambers disposed adjacent to one another and having an opening therebetween;

an ionizable gas contained within said first and second chambers;

a cathode disposed within said second chamber and having an electron emissive surface facing said opening and oriented substantially parallel thereto;

a first grid electrode disposed across said opening;

a thin wire electrode projecting into said first chamber;

means for applying relatively low voltages between said first grid electrode and said housing means and between said thin wire electrode and said housing means to establish a plasma discharge within said first chamber whereby positive ions are generated therein;

means for applying between said cathode and said housing means a large negative voltage sufficient to cause positive ions generated within said first chamber to travel through said opening into said second chamber and bombard said electron emissive surface such that secondary electrons are emitted therefrom to form an electron beam which travels through said opening into said first chamber;

means for applying a modulating voltage between said first grid electrode and said housing means to control the density of positive ions passing through said first gride electrode in accordance with said modulating voltage;

a second grid electrode disposed across said opening between said first grid electrode and said cathode and directly electrically connected to said housing means; and an electron transmissive window attached to said housing means and aligned with at least respective portions of said opening and said electron emissive surface.

* * * * *

UNITED STATES PATENT OFFICE

CERTIFICATE OF CORRECTION

PATENT NO. : 3,970,892

DATED : July 20, 1976

INVENTOR(S) : George Wakalopulos

It is certified that error appears in the above-identified patent and that said Letters Patent are hereby corrected as shown below:

Col. 5, line 32, "electrode" should be --electron--;
(Claim 2, line 1)
Col. 5, line 50, "electrode" should be --electron--.
(Claim 6, line 1)
Col. 6, line 45, "whereby" should be --means--;
(Claim 8, line 9)
Col. 6, line 46, "wherby" should be --whereby--.
(Claim 8, line 10)

Signed and Sealed this

Twenty-third Day of November 1976

[SEAL]

*Attest:*

RUTH C. MASON
*Attesting Officer*

C. MARSHALL DANN
*Commissioner of Patents and Trademarks*